United States Patent [19]

Furda

[11] Patent Number: 4,526,368

[45] Date of Patent: Jul. 2, 1985

[54] GAME APPARATUS

[76] Inventor: John G. Furda, 1031 W. 17th Place, Lakewood, Colo. 80215

[21] Appl. No.: 636,382

[22] Filed: Jul. 31, 1984

[51] Int. Cl.[3] ..... A63D 13/00

[52] U.S. Cl. ..... 273/14; 273/59 R

[58] Field of Search ..... 273/59 R, 2, 14, 123 R, 273/176 R, 3 R, 3 A, 8, 34 R, 87 C, 178 R, 79 R, DIG. 26, 125 R, 4 A, 87 B

[56] References Cited

U.S. PATENT DOCUMENTS

| | | | |
|---|---|---|---|
| 580,253 | 4/1897 | Clarke | 273/59 R |
| 636,257 | 11/1899 | Gibbson et al. | 273/14 |
| 1,118,727 | 11/1914 | Bibleault | 273/59 R |
| 1,899,830 | 2/1933 | Small, Jr. | 273/2 |
| 4,004,804 | 1/1977 | Cholson | 273/59 R |
| 4,201,383 | 5/1980 | Schaller | 273/14 |

FOREIGN PATENT DOCUMENTS

| | | | |
|---|---|---|---|
| 770061 | 9/1934 | France | 273/14 |

*Primary Examiner*—Richard C. Pinkham
*Assistant Examiner*—T. Brown
*Attorney, Agent, or Firm*—Klaas & Law

[57] ABSTRACT

Apparatus for playing a game wherein a set of object balls of different colors and markings and numbers are selectively driven into pocket areas on a flat playing surface and a cue ball adapted to be struck with a hand-held device such as a cue stick or a mallet, and the apparatus comprises at least four solid color balls, a striped ball, and ten numbered balls including the numbers one to nine and a second number five.

4 Claims, 2 Drawing Figures

GAME APPARATUS

This invention relates to billiard type game apparatus and more particularly, to a pocket billiard type game apparatus played with balls and cues on a billiard table.

Various types of prior art game apparatus are disclosed in the U.S. Pat. Nos. 580,253; 581,587; 984,463; 1,118,727; 3,138,387; 3,287,017; 3,544,108; 3,958,804; 3,985,355; 4,004,804; 4,114,876 and 4,251,072.

The object of the present invention is to provide new and improved game apparatus for enabling the playing of a new and improved game. The game is played on a pocket billiard table with balls and cue sticks, or on a lawn-type surface for croquet or the like with balls and mallets or other similar apparatus.

The apparatus of the present invention comprises a set of object balls of different colors and markings and numbers are selectively driven into pocket areas on a flat playing surface and a cue ball adapted to be struck with a hand-held device such as a cue stick or a mallet, and the apparatus consists of the following elements: (1) a cue ball of white color; (2) a ball having a marking such as a stripe, which is distinctive from any other ball of the set and used as a wild card type ball to be selectively counted as any number from 1 to 10; (3) a first group of four solid color balls without numbers and with two of the group being of the same distinctive color different from the color of any other balls of the set and two of the group being of the same distinctive color different from the color of any of the other balls of the set; and (4) a second group of ten numbered balls with nine of the balls having one of the numbers 1 through 9 marked thereon and one of the group of numbered balls having another number 5 marked thereon and with the number 1 and number 9 balls having the same distinctive color different from the color of any other balls of the set, the number 2 and the number 8 balls having the same distinctive color different from the color of any other balls of the set, the number 3 and number 7 balls having the same distinctive color different than the color of any other balls of the set, the number 4 and number 6 balls having the same distinctive color different than the color of any other balls of the set and the two number 5 balls having the same distinctive color different than the color of any other balls of the set.

DETAILED DESCRIPTION

Figure 1:
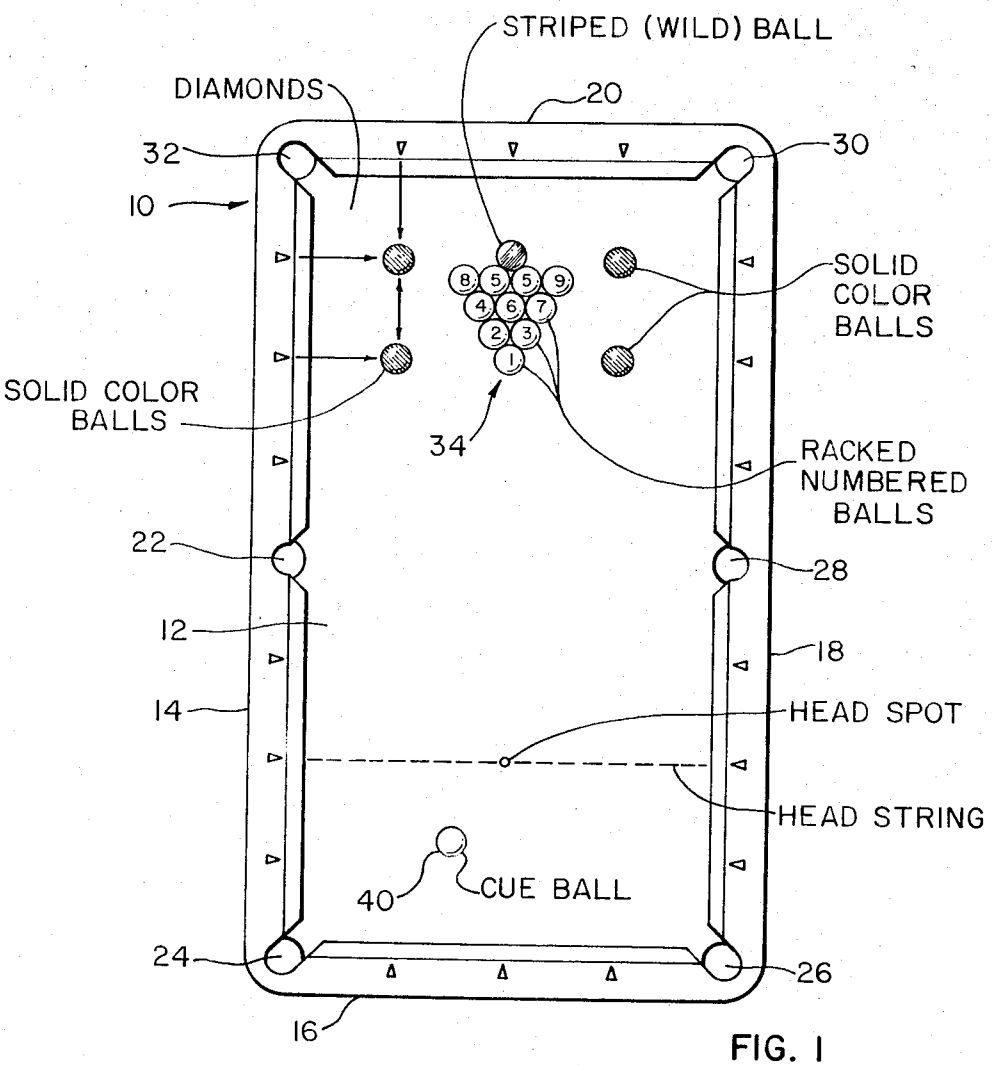
FIG. 1 is a top view of a pocket billiard table with a set of balls shown thereon.
Figure 2:
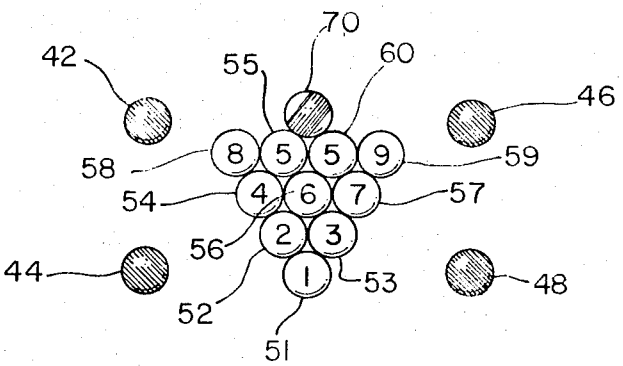
FIG. 2 is an enlarged top view of the set of balls.

FIG. 1 shows a conventional pocket billiard table 10 having a playing surface 12, side rails 14, 16, 18, 20 and a plurality of pockets (i.e., 6) 22, 24, 26, 28, 30, 32 with a set of game balls 34 located thereon. A set of game balls comprises 15 balls plus a cue ball 40 which may be of conventional white color; at least four solid color balls 42, 44, 46, 48; ten numbered balls 51, 52, 53, 54, 55, 56, 57, 58, 59, 60 with numbers from 1 to 9 plus an extra number five ball; and at least one striped ball 70.

Two of the solid color balls 42, 44 have the same distinctive color (e.g., light red), which is a different color than the color of any other balls, and two of the solid color balls 46, 48 have the same distinctive color (e.g., green) which is a different color than the color of any other balls.

The ten numbered balls are divided into five pairs of balls having the same distincitve color which is a different color than the color of any of the other balls. Each pair of distinctive color numbered balls have numbers totaling the number 10. Thus, the number 1 ball and the number 9 ball have the same distinctive color (e.g. yellow), the number 2 ball and the number 8 ball have the same distinctive color (e.g. blue), the number 3 ball and the number 7 ball have the same distinctive color (e.g. dark red), the number 4 ball and the number 6 ball have the same distinctive color (e.g. purple), and the two number 5 balls have the same distinctive color (e.g. orange).

In addition, in order to better distinguish the number 1 to 4 balls from the same colored number 6 to 9 balls, one or the other of the 1–4 group of balls or the 6–9 group of balls may be provided with additional markings such as a stripe or speckling. It is preferred that the higher numbered (6–9) group of balls be so marked.

In use, at the beginning of the game, the object balls may be placed on the billiard table as shown in FIG. 1 with the numbered balls 51–60 located in a triangular configuration by a conventional rack device, the striped ball 70 located between and behind the number 5 balls, and the four solid color balls 42, 44, 46, 48, placed in laterally equally spaced juxtaposition to the numbered balls as illustrated in FIG. 1. The cue ball is placed at the other end of the table as illustrated.

The game may be played by two players or by teams of players. The players alternate turns (i.e., innings). Each player continues to play until the player takes the number of turns allotted in any inning. A point system is established for pocketing of particular balls and combinations of balls and balls in numerical series. Players or groups of players may be designated different colored balls.

Basic Playing Format

The object of the game is to pocket those balls and combinations of balls that will be awarded the most points in an inning and in a game of ten innings. Players may combine and rearrange pocketed ball combinations for the highest point values in the inning.

Special point values are awarded as follows: 25 points—pocket any solid colored ball or the striped (wild) ball with the first shot of an inning. 30 points plus an extra shot—pocket 3 numbered balls, randomly or accidentally, which make up a numerical series with any 1, 2 or all 3 shots in the inning. These do not have to be made in rotation. 15 points plus an extra shot—for each additional numbered ball pocketed continuing the above three ball series in the inning—higher or lower numbered balls. At this point, the balls must now be pocketed in rotation. A numbered ball, randomly or accidentally, pocketed in the inning can be placed into the numerical series when it can be placed in a proper numerical rotation of the series. It is awarded the 15 points plus an extra shot. The rotation can continue until all numbered balls are pocketed in the inning or when the player misses a ball to continue the rotation play.

With any 1, 2 or all 3 shots in the inning, 20 points are awarded for pocketing the following: (1) two solid colored balls; (2) the striped (wild) ball and a solidcolored ball; (3) the striped (wild) ball and a numbered ball; (4) a pair of matching color-numbered balls. The ball numbers total 10, but are awarded 20 points. 15 points are awarded for pocketing a numbered ball and a solid colored ball. 5 points are awarded for pocketing a solid colored ball or the striped ball as the only ball pocketed in the inning except when either is pocketed with the first shot and are the only two balls pocketed in the inning, one ball is awarded 25 points and the other 5 points for a total of 30 points in the inning. Any numbered balls pocketed in the inning which cannot be matched or combined with other balls for any of the special point values is awarded the ball number or when more than one ball, the total of the ball numbers which points are in addition to any other points awarded in the inning.

All balls pocketed with the first shot in the inning are also used for point values in the inning. The striped ball, when played as the "wild" ball, may substitute for a numbered ball. The substituted numbered ball may also be legally pocketed for other point values in the inning. The striped "wild" ball may substitute in the following ways: (1) making up a numerical series; (2) continuing the numerical series; (3) a pocketed substituted numbered ball replaces the "wild" ball and is re-entered into the series in sequence and is awarded the extra shot. The "wild" ball substitutes the next numbered ball to continue the series. This may be repeated to play out the series or until a shot is missed.

After each two innings are played, shooters may re-rack and re-spot all balls, the balls pocketed and those remaining live on the table. The next two innings are played with the cue ball in hand behind the head string, and the next shooter makes the next break; or, by respotting only pocketed balls after two innings of play.

After a player shoots two innings, all pocketed balls in the two innings may be respotted on the break spots designated for the solid colored ball and the striped and numbered balls. The four solid colored balls may all be placed within the rack in the back row or randomly throughout the rack.

The break shot winner may elect to shoot to score by pocketing one of the solid colored balls with the first shot of the inning, shoot to break up the rack only or both, score with a solid colored ball and break the rack. All balls pocketed in the game legally are awarded specific point values whether as a single ball or in combination with other balls with one, two or all three shots in an inning. Specific ball combinations are awarded high point values in the inning in which they are pocketed. The striped ball may be pocketed advantageously with other ball combinations for points in an inning when it is used as the "wild" ball. The two No. 5 balls can be used in making up a three ball numerical series, i.e., 4-5-5, 5-5-4, as well as continuing the numerical series, i.e., 3-4-5-5-6, 1-2-3-4-5-5-6. Using both 5's in this manner is the same as other numbered balls falling in placing the numerical sequence.

Players may vie for the break shot. Players may alternate shooting the break shot. Rack balls to start a new game. Rack and respot when the majority of the playable balls, i.e., six of the numbered and/or three solid colored balls have been pocketed in either the first and/or second of the two innings played. When players are designated only a pair of solid colored balls, respot both when both are pocketed in the first of two innings for the second of two innings. This provides continuity to the game.

Balls pocketed accidentally as a scratch remain pocketed and are counted as points. Balls pocketed along with the cue ball on a scratch remain pocketed, but are not counted for points. The cue ball is retrieved for the next shot played from or behind the head string. Jumped balls are placed in pockets and are not counted for points. After two innings are played, all balls are retrieved from the pockets and are respotted and/or racked. The player has the cue ball in hand behind the head string to start the game or to place a jumped or scratched cue ball into play within the two innings. The incoming player has the cue ball in hand and may place it anywhere on the playing surface when the cue ball is a jumped or scratched ball on the last shot of the second of two innings by the outgoing player.

The point values awarded in each inning are complete for the inning and are added to the previous inning score for the inning's total score. The 10th inning score is the game score. Extra innings may be played to break tied game scores.

The striped "wild" ball's special point values may be varied as follows:

From 25 1 to 30 points when it is pocketed with the first shot of the inning by itself or in combination with other pocketed balls. From 5 points to 10 points when it is the remaining ball used in scoring and substituted while playing for a thirty point numerical series (Eagle). This is in addition to the awarded score for the last pocketed ball for the Eagle. To 25 points when it is used in combination with a pocketed solid colored ball. To 10 points when it is the only ball pocketed in the inning except when it is pocketed with the first shot. When it is pocketed in combination with a solid colored ball with the first shot of the inning, the solid colored ball is awarded 25 points (Ace) and the striped "wild" ball remains in play as a possible combination with other balls for appropriate scoring. When no other balls are pocketed with the remaining two shots in the inning, the striped "wild" ball is awarded the 10 points in addition to the 25 points for the Ace in the inning.

While an illustrative and presently preferred manner of playing the game has been described, the manner of playing the game may be varied as necessary or desirable to suit the interests and skills of the players. It is intended that the scope of the appended claims be construed to include modifications and variations of the invention except insofar as limited by the prior art.

What is claimed is:

1. Apparatus for playing a game wherein a set of object balls of different colors and markings and numbers are selectively driven into pocket areas on a flat playing surface and a cue ball adapted to be struck with a hand-held device such as a cue stick or a mallet, and the apparatus comprising:

a cue ball of white color;

a ball having a distinctive marking, which is distinctive from any other ball of the set and used as a wild card type ball to be selectively counted as any number from 1 to 10;

a first group of four solid color balls without numbers and with two of said group being of the same distinctive color different from the color of any other balls of the set and two of the group being of the same distinctive color different from the color of any of the other balls of the set; and a second group of ten numbered balls with nine of the balls having each one of the numbers 1 through 9 marked thereon and another one of the group of numbered balls having a second number 5 marked thereon and with the number 1 and number 9 balls having the same distinctive color different from the color of any other balls of the set, the number 2 and the number 8 balls having the same distinctive color different from the color of any other balls of the set, the number 3 and number 7 balls having the same distinctive color different than the color of any other balls of the set, the number 4 and number 6 balls having the same distinctive color different than the color of any other balls of the set and the two number 5 balls having the same distinctive color different than the color of any other balls of the set.

2. The invention as defined in claim 1 and wherein said second group of numbered balls further comprising a sub-group of numbered balls which have markings thereon distinctive from the other balls of the set.

3. The invention as defined in claim 2 and wherein said sub-group of numbered balls bear the numbers 1 to 4.

4. The invention as defined in claim 2 and wherein said sub-group of numbered balls bear the numbers 6 to 9.

* * * * *